US010843356B2

(12) United States Patent
Lee et al.

(10) Patent No.: US 10,843,356 B2
(45) Date of Patent: Nov. 24, 2020

(54) RAZOR CARTRIDGE

(71) Applicant: DORCO CO., LTD., Seoul (KR)

(72) Inventors: Kyong Sik Lee, Seoul (KR); Jin Woo Jung, Seoul (KR); Bo Ra Kim, Seoul (KR); Jae Joon Lee, Seoul (KR); Sung Hee Son, Seoul (KR)

(73) Assignee: DORCO CO., LTD., Seoul (KR)

( * ) Notice: Subject to any disclaimer, the term of this patent is extended or adjusted under 35 U.S.C. 154(b) by 28 days.

(21) Appl. No.: 16/079,027

(22) PCT Filed: Aug. 1, 2016

(86) PCT No.: PCT/KR2016/008428
§ 371 (c)(1),
(2) Date: Aug. 22, 2018

(87) PCT Pub. No.: WO2017/146321
PCT Pub. Date: Aug. 31, 2017

(65) Prior Publication Data

US 2019/0047164 A1 Feb. 14, 2019

(30) Foreign Application Priority Data

Feb. 22, 2016 (KR) ..... 10-2016-0020456

(51) Int. Cl.
*B26B 21/40* (2006.01)
*B26B 29/02* (2006.01)

(52) U.S. Cl.
CPC ..... *B26B 21/4025* (2013.01); *B26B 21/40* (2013.01); *B26B 21/4012* (2013.01);
(Continued)

(58) Field of Classification Search
CPC . B26B 21/4025; B26B 21/40; B26B 21/4012; B26B 21/4018; B26B 21/4037;
(Continued)

(56) References Cited

U.S. PATENT DOCUMENTS 4,996,772 A * 3/1991 Iten ..... B26B 21/4037 30/123.3
5,687,485 A 11/1997 Shurtleff et al.
(Continued)

FOREIGN PATENT DOCUMENTS

CN 101489741 7/2009
CN 101578163 11/2011
(Continued)

OTHER PUBLICATIONS

PCT International Application No. PCT/KR2016/008428, International Search Report dated Nov. 15, 2016, 4 pages.
(Continued)

*Primary Examiner* — Kenneth E Peterson
*Assistant Examiner* — Nhat Chieu Q Do
(74) *Attorney, Agent, or Firm* — Lee, Hong, Degerman, Kang & Waimey

(57) ABSTRACT

According to an aspect of the inventive concept, a razor cartridge comprises: at least one of a main blade; a trimmer blade; a housing accommodating the main blade so as for cutting edges of the main blade to be exposed at the front of the housing and accommodating the trimmer blade so as for a cutting edge of the trimmer blade to be exposed at the rear of the housing; and a trimmer cover provided at the rear of the housing to be vertically slidable and to move back and forth between a first position and a second position.

15 Claims, 12 Drawing Sheets

(52) U.S. Cl.
CPC ..... *B26B 21/4018* (2013.01); *B26B 21/4037* (2013.01); *B26B 21/4043* (2013.01); *B26B 29/02* (2013.01)

(58) Field of Classification Search
CPC ..... B26B 21/4043; B26B 21/00–38; B26B 21/24–50; B26B 21/54–60
USPC ..... 30/34.1
See application file for complete search history.

(56) References Cited

U.S. PATENT DOCUMENTS

| | | | | |
|---|---|---|---|---|
| 5,761,814 | A | 6/1998 | Anderson et al. | |
| 5,956,848 | A | 9/1999 | Tseng et al. | |
| 5,956,851 | A | 9/1999 | Apprille et al. | |
| 6,041,926 | A | 3/2000 | Petricca et al. | |
| 6,052,903 | A | 4/2000 | Metcalf et al. | |
| 6,185,822 | B1 | 2/2001 | Tseng et al. | |
| 6,212,777 | B1 | 4/2001 | Gilder et al. | |
| 6,442,839 | B1 | 9/2002 | Tseng et al. | |
| 6,516,518 | B1 | 2/2003 | Garraway et al. | |
| 6,612,040 | B2 | 9/2003 | Gilder | |
| 6,684,513 | B1 | 2/2004 | Clipstone et al. | |
| 8,065,802 | B2 | 11/2011 | Oglesby et al. | |
| 8,083,114 | B1 * | 12/2011 | Steele | B65H 35/0026 225/20 |
| 8,359,751 | B2 | 1/2013 | Efthimiadis et al. | |
| 8,567,068 | B2 * | 10/2013 | Luxton | B26B 21/4018 30/34.1 |
| 8,782,903 | B2 | 7/2014 | Clarke et al. | |
| 9,193,080 | B2 | 11/2015 | Whelan et al. | |
| 2005/0022386 | A1 | 2/2005 | Macove | |
| 2008/0250647 | A1 | 10/2008 | Fischer et al. | |
| 2010/0011584 | A1 * | 1/2010 | Efthimiadis | B26B 21/225 30/34.1 |
| 2011/0023305 | A1 | 2/2011 | Whelan et al. | |
| 2011/0203124 | A1 * | 8/2011 | Bridges | B26B 21/4037 30/539 |

FOREIGN PATENT DOCUMENTS

| | | |
|---|---|---|
| CN | 102448685 | 5/2012 |
| CN | 102596520 | 7/2012 |
| DE | 8717729 | 10/1989 |
| EP | 0287387 | 10/1988 |
| JP | 2001187283 | 7/2001 |
| JP | 2012527326 | 11/2012 |
| KR | 200448495 | 4/2010 |
| KR | 1020110126158 | 11/2011 |
| WO | 2008023210 | 2/2008 |
| WO | 2008023211 | 2/2008 |
| WO | 2015134700 | 9/2015 |

OTHER PUBLICATIONS

European Patent Office Application Serial No. 16891725.0, Search Report dated Oct. 7, 2019, 6 pages.
Japan Patent Office Application No. 2018-543350, Office Action dated Jul. 16, 2019, 4 pages.
Japan Patent Office Application No. 2018-543350, Notice of Allowance dated Oct. 29, 2019, 3 pages.
The State Intellectual Property Office of the People's Republic of China Application Serial No. 201680078370.4, Search Report dated May 8, 2019, 2 pages.
The State Intellectual Property Office of the People's Republic of China Application Serial No. 201680078370.4, Search Report dated Dec. 5, 2019, 2 pages.
The State Intellectual Property Office of the People's Republic of China Application Serial No. 201680078370.4, Notice of Allowance dated Jan. 9, 2020, 2 pages.

* cited by examiner

RAZOR CARTRIDGE

CROSS-REFERENCE TO RELATED APPLICATIONS

This application is the National Stage filing under 35 U.S.C. 371 of International Application No. PCT/KR2016/008428, filed on Aug. 1, 2016, which claims the benefit of earlier filing date and right of priority to Korean Application No. 10-2016-0020456, filed on Feb. 22, 2016, the contents of which are all hereby incorporated by reference herein in their entirety.

TECHNICAL FIELD

The present invention relates to a razor cartridge, and more particularly, to a razor cartridge including a trimmer blade.

BACKGROUND ART

There are shaving razors having a trimmer blade for manicuring sideburns or other facial hair around the nose. The trimmer blade is generally installed at the rear of a razor cartridge.

However, since the trimmer blade is exposed at the rear of the razor cartridge, the user often gets an injury such as a cut on the finger from the trimmer blade during the replacement or use of the razor cartridge.

DISCLOSURE

Technical Problems

To address the aforementioned problems, exemplary embodiments of the present invention provide a razor cartridge that includes a trimmer blade and can be used safely.

Additional advantages, subjects, and features of the present invention will be set forth in part in the description that follows and in part will become apparent to those having ordinary skill in the art upon examination of the following or may be learned from practice of the present invention.

Technical Solutions

According to an aspect of the inventive concept, there is provided a razor cartridge, comprising: at least one of a main blade; a trimmer blade; a housing accommodating the main blademain blade so as for cutting edges of the main blademain blade to be exposed at the front of the housing and accommodating the trimmer blade so as for a cutting edge of the trimmer blade to be exposed at the rear of the housing; and a trimmer cover provided at the rear of the housing to be vertically slidable and to move back and forth between a first position and a second position.

When the trimmer cover is placed at the second position, the cutting edge of the trimmer blade may be located near an imaginary trimming plane that an upper end of the housing and an upper end of the trimmer cover are both placed in contact with.

When the trimmer cover is placed at the second position, the upper end of the trimmer cover may be located below the cutting edge of the trimmer blade.

The upper end of the trimmer cover may be positioned higher when the trimmer cover is placed at the first position than when the trimmer cover is placed at the second position.

Guide rails may be formed at the housing to guide the vertical movement of the trimmer cover, and the trimmer cover may include sliding rails, which move along the guide rails.

The guide rails may include fixing protrusions, respectively, which protrude outwardly, and the sliding rails may include first receiving parts, respectively, which engage with the fixing protrusions, respectively, and thus maintain the trimmer cover at the first position when the trimmer cover is placed at the first position, and second receiving parts, respectively, which engage with the fixing protrusions, respectively, and thus maintain the trimmer cover at the second position when the trimmer cover is placed at the second position.

The sliding rails may include fixing protrusions, respectively, which protrude outwardly, and the guide rails may include first receiving parts, respectively, which engage with the fixing protrusions, respectively, and thus maintain the trimmer cover at the first position when the trimmer cover is placed at the first position, and second receiving parts, respectively, which engage with the fixing protrusions, respectively, and thus maintain the trimmer cover at the second position when the trimmer cover is placed at the second position.

The razor cartridge may include a trimmer guard provided between the trimmer blade and the trimmer cover, wherein the trimmer guard forms, together with the housing, an imaginary trimming plane that is adjacent to the cutting edge of the trimmer blade.

When the trimmer cover is placed at the first position, the upper end of the trimmer cover may be located above the trimming plane.

When the trimmer cover is placed at the second position, the upper end of the trimmer cover may be located below the trimmer plane.

Other specific details of the present invention are included in the detailed description and the drawings.

Advantageous Effects

Exemplary embodiments of the present invention have the following advantages.

By using a slidable trimmer cover, the cutting edge of a trimmer blade can be prevented from being exposed when the trimmer blade is not in use. Accordingly, a razor cartridge can be used safely.

Other features and exemplary embodiments may be apparent from the following detailed description, the drawings, and the claims.

BEST MODES FOR CARRYING OUT THE INVENTION

Figure 1:
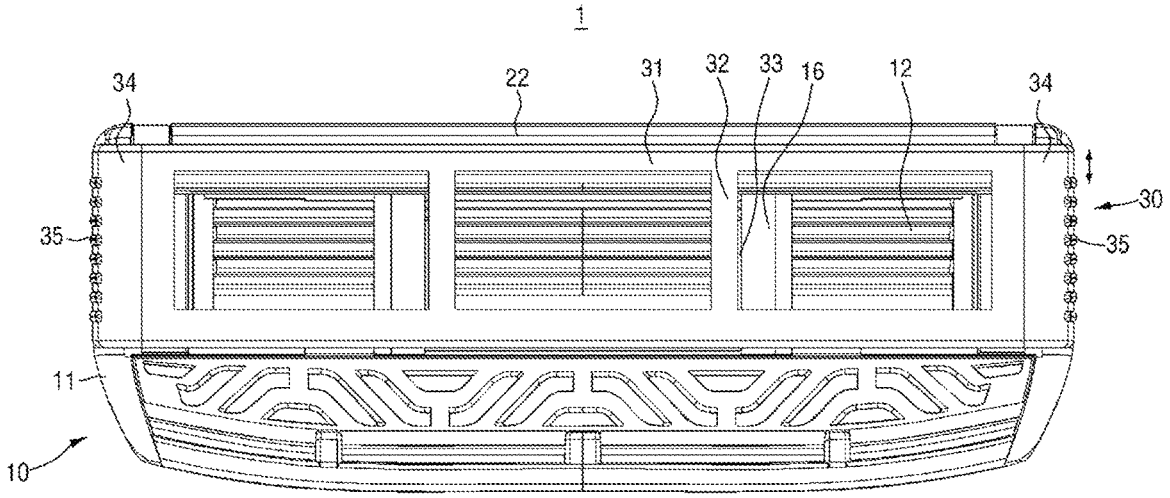
FIG. 1 is a rear view of a razor cartridge according to a first exemplary embodiment of the present invention.

The present invention will now be described more fully hereinafter with reference to the accompanying drawings, in which preferred embodiments of the invention are shown. This invention may, however, be embodied in different forms and should not be construed as limited to the embodiments set forth herein. Rather, these embodiments are provided so that this disclosure will be thorough and complete, and will filly convey the scope of the invention to those skilled in the art. The same reference numbers indicate the same components throughout the specification. In the attached figures, the thickness of layers and regions is exaggerated for clarity.

In addition, the embodiments described herein will be described with reference to cross-sectional views and/or schematic drawings that are ideal illustrations of the present invention. Thus, the shape of the illustrations can be modified by manufacturing techniques and/or tolerances. In addition, in the drawings of the present invention, each component may be somewhat enlarged or reduced in view of convenience of description. Same reference numbers refer to same elements throughout the specification.

Hereinafter, the present invention will be described with reference to the drawings for explaining a razor cartridge according to embodiments of the present invention.

Figure 2:
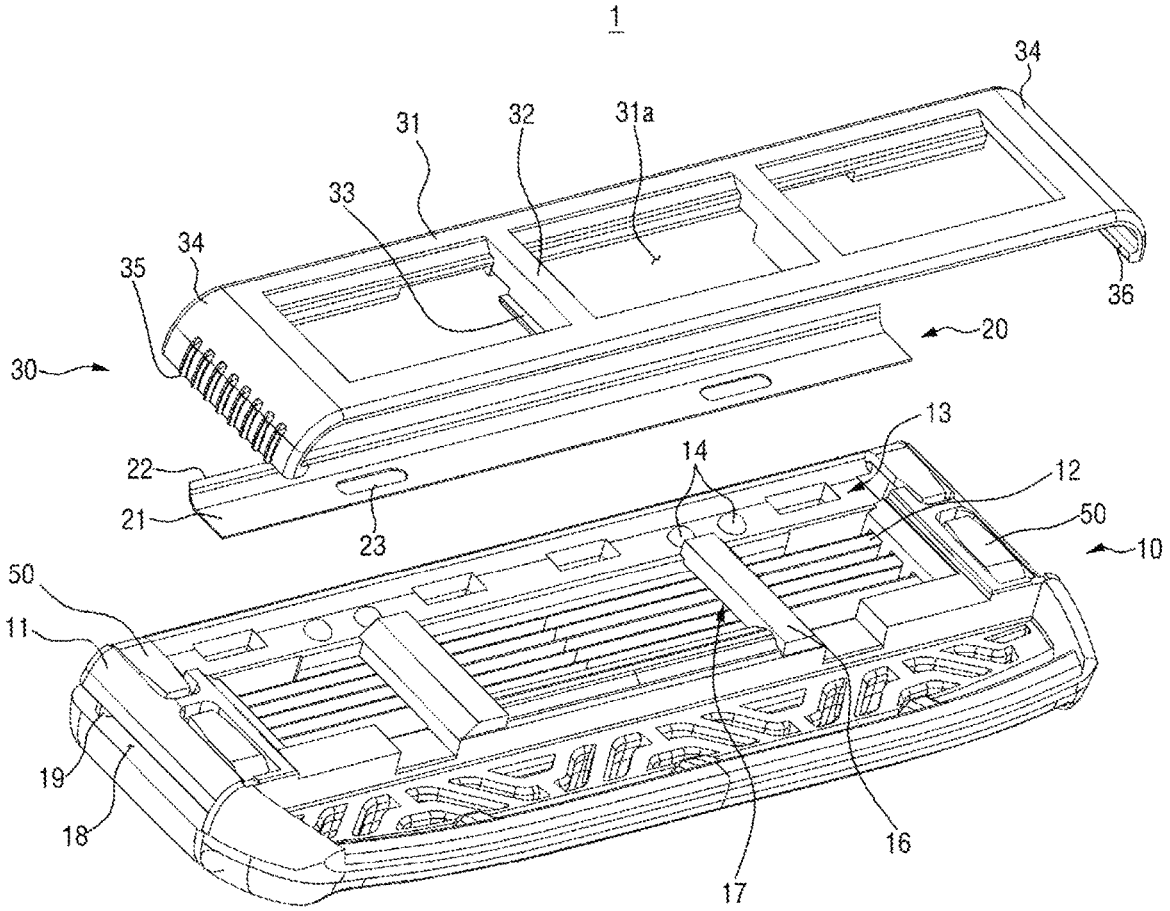
FIG. 2 is an exploded perspective view of the razor cartridge according to the first exemplary embodiment.

FIG. 1 is a rear view of a razor cartridge according to a first exemplary embodiment of the present invention, and FIG. 2 is an exploded perspective view of the razor cartridge according to the first exemplary embodiment.

Referring to FIGS. 1 and 2, a razor cartridge 1 according to the first exemplary embodiment includes a housing 10, a trimmer blade 20, and a trimmer cover 30.

As illustrated in FIG. 2, the housing 10 includes a frame 11, which is substantially rectangular and at least one of the main blade 12, from side to side. The housing 10 provides at least one of the main blade 12, specifically a plurality of main blades 12 provided in the housing 10 will hereinafter be described. The housing 10 accommodates the main blades 12 so that cutting edges (not illustrated) of the main blades 12 are exposed at the front of the housing 10. The main blades 12 may be fixed within the housing 10 by clips 50 that are coupled to the frame 11.

As illustrated in FIG. 2, a trimmer blade installation groove 13 in which a trimmer blade 20 is seated is formed at the rear of the frame 11. A plurality of engaging protrusions 14 may be formed to protrude rearwardly in the trimmer blade mounting groove 13.

The engaging protrusions 14 are provided for fixing the trimmer blade 20 to the trimmer blade installation groove 13. FIG. 2 illustrates an exemplary trimmer blade installation groove 13 having four engaging protrusions 14 formed therein, but the location and the number of the engaging protrusions 14 may vary.

First guide rails 18 are formed on both sides of the frame 11 to be recessed on the inside of the frame 11. As illustrated in FIG. 2, the first guide rails 18 are formed on both sides of the frame 11 to extend in a vertical direction. The first guide rails 18 are provided with fixing protrusions 19, respectively, protruding outwardly from the frame 11.

As illustrated in FIG. 2, a pair of second guide rails 16 may be additionally provided at the rear of the frame 11 to connect upper and lower parts of the frame 11. Slits 17 may be formed at the front of the second guide rails 16 to face, and be open to, the second guide rails 16.

As illustrated in FIG. 2, the trimmer blade 20 includes a trimmer base 21, which is bent once and is substantially L-shaped, and a cutting edge 22, which is formed at an end of the trimmer blade 20.

As illustrated in FIG. 2, engaging holes 23 into which the engaging protrusions 14 are inserted are formed at the trimmer base 21.

The trimmer blade 20 is disposed so as for the trimmer base 21 to be placed in contact with the trimmer blade installation groove 13. The trimmer blade 20 is disposed in the trimmer blade installation groove 13 so as for the cutting edge 22 to face the rear of the housing 10.

The engaging protrusions 14 may be rivet-coupled to the engaging holes 23 and may thus fix the trimmer blade 20 to the trimmer blade installation groove 13. Alternatively, the engaging protrusions 14 may be inserted into the engaging holes 23 and may thus align the installation location of the trimmer blade 20 or fix the trimmer blade 20 to the trimmer blade installation groove 13. Alternatively, the engaging protrusions 14 may not be provided.

As illustrated in FIG. 2, the trimmer cover 30 includes a cover base 31, which has the shape of a rectangular frame.

The trimmer cover 30 includes cover sides 34, which extend from both sides of the cover base 31. As illustrated in FIG. 2, first sliding rails 36, which are inserted into the first guide rails 18, are formed at the ends of the cover sides 34. The first sliding rails 36 are installed to be vertically slidable along the first guide rails 18.

Figure 6:
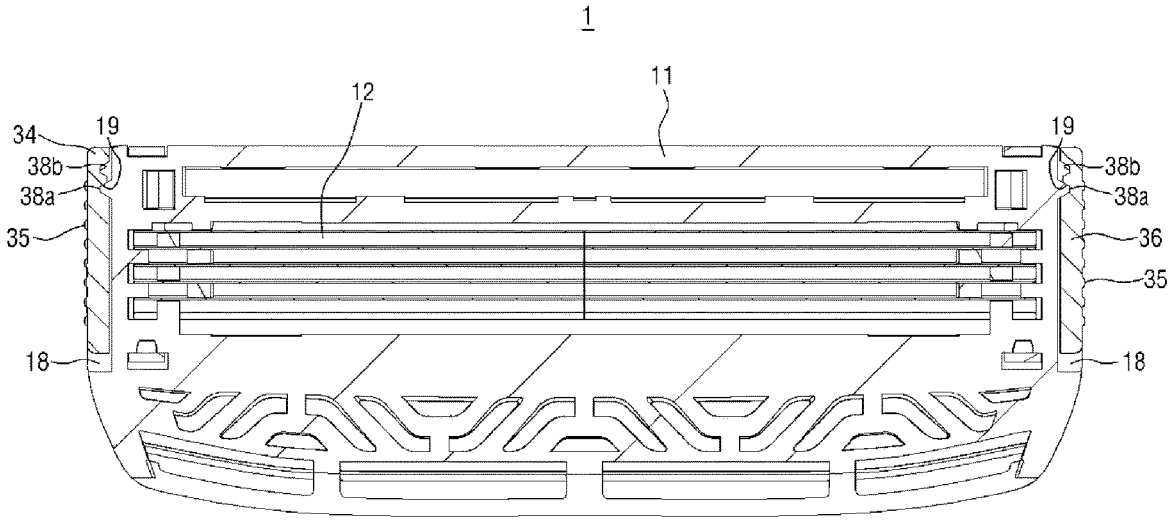
FIG. 6 is a cross-sectional view taken along line B-B of FIG. 4.

The first sliding rails 36 are provided with first receiving parts 38*a*, respectively, and second receiving parts 38*b*, respectively, which are formed as recesses and are a predetermined distance apart from each other (See FIG. 6).

As illustrated in FIGS. 1 and 2, a plurality of grip protrusions 35 are formed on the outer side surface of each of the cover sides 34 to protrude outwardly. The grip protrusions 35 are provided to improve a user's grip of the trimmer cover 30 when the trimmer cover 30 is slid against the housing 10 to be switched from a first position (See FIG. 3) to a second position (See FIG. 7).

The trimmer cover 30 includes two connecting bars 32, which connect upper and lower parts of the cover base 31. The connecting bars 32 vertically support a middle part of the cover base 31. The cover base 31 forms a plurality of grating spaces 31*a*, which are separated by the connecting bars 32. The grating spaces 31*a* allow washing water to pass through the front and rear of the razor cartridge 1 to clean the main blades 12 and the like when the razor cartridge 1 is being washed.

Second sliding rails 33 are formed at the front ends of the connecting bars 32 to protrude outwardly. The second sliding rails 33 are inserted into the slits 17 of the second guide rails 16 so as to be vertically movable along the second guide rails 16.

The first sliding rails 36 are installed to be movable along the first guide rails 18, and the second sliding rails 33 are installed to be movable along the second guide rails 16. Thus, as illustrated in FIG. 1, the trimmer cover 30 is installed at the rear of the housing 10 and is thus slidable in the vertical direction where the first guide rails 18 and the second guide rails 16 are formed.

The trimmer cover 30 is vertically slidable, and is movable back and forth between the first position (See FIG. 3) where the cutting edge 22 of the trimmer blade 20 is hidden and the second position (See FIG. 7) where the cutting edge 22 of the trimmer blade 20 is exposed. A state in which the trimmer cover 30 is placed at the first position and a state in which the trimmer cover 30 is placed at the second position will hereinafter be described.

Figure 3:
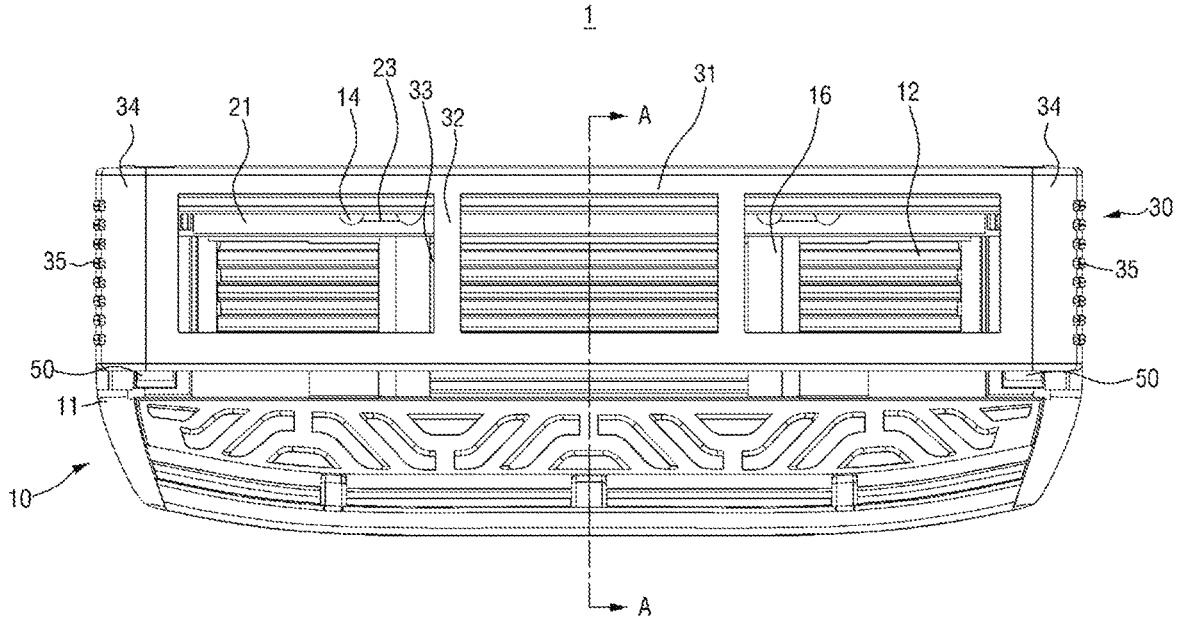
FIG. 3 is a rear view of the razor cartridge according to the first exemplary embodiment in a state where a trimmer cover of the razor cartridge according to the first exemplary embodiment is placed at a first position.
Figure 4:
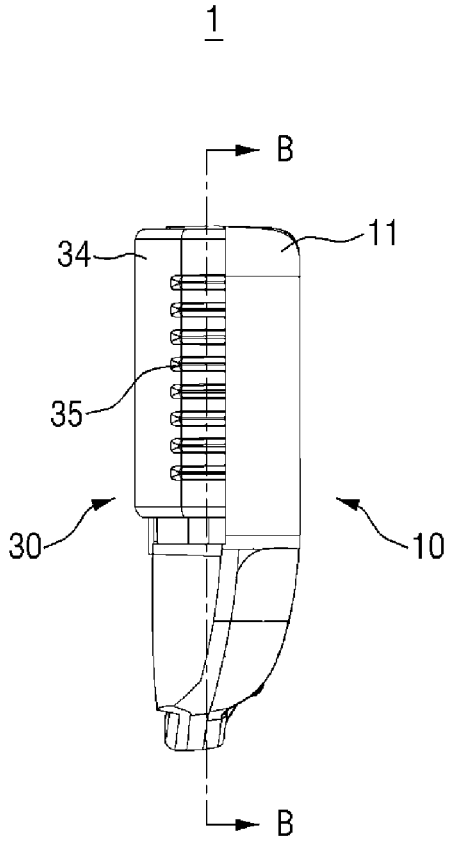
FIG. 4 is a side view of the razor cartridge according to the first exemplary embodiment in a state where the trimmer cover of the razor cartridge according to the first exemplary embodiment is placed at the first position.
Figure 5:
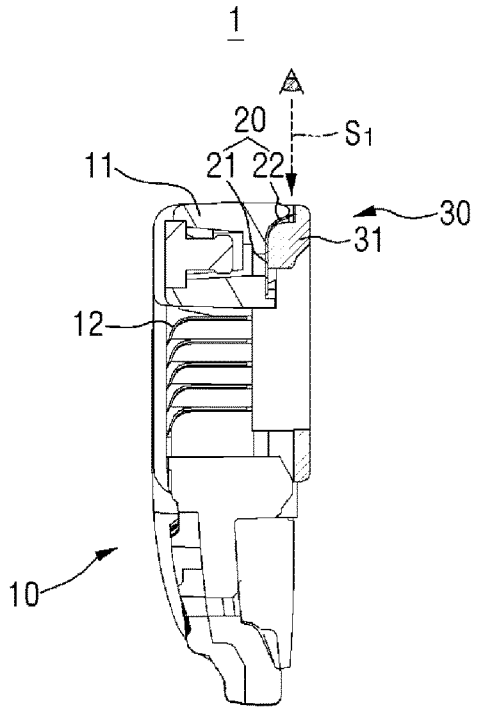
FIG. 5 is a cross-sectional view taken along line A-A of FIG. 3.

FIG. 3 is a rear view of the razor cartridge according to the first exemplary embodiment in a state where the trimmer cover of the razor cartridge according to the first exemplary embodiment is placed at the first position, FIG. 4 is a side view of the razor cartridge according to the first exemplary embodiment in a state where the trimmer cover of the razor cartridge according to the first exemplary embodiment is placed at the first position, FIG. 5 is a cross-sectional view taken along line A-A of FIG. 3, and FIG. 6 is a cross-sectional view taken along line B-B of FIG. 4.

Referring to FIGS. 3 and 4, when the trimmer cover 30 is placed at the first position, an upper end of the trimmer cover 30 is located above the cutting edge of the trimmer blade 20.

Thus, the cutting edge 22 of the trimmer blade 20 is hidden from view by the cover base 31 of the trimmer cover 30, as viewed from the rear of the razor cartridge 1, and is hidden from view by the cover sides 34 of the trimmer cover 30, as viewed from the sides of the razor cartridge 1.

Referring to FIG. 5, the cutting edge 22 of the trimmer blade 20 can be observed between the frame 11 and the trimmer cover 30, only when viewed from a direction $S_1$ from above the razor cartridge 1.

Accordingly, when the trimmer cover 30 is placed at the first position, the cutting edge 22 of the trimmer blade 20 can be observed, only when viewed from the direction $S_1$ from above the razor cartridge 1, and is not exposed to the outside of the razor cartridge 1. Thus, when the trimmer cover 30 is placed at the first position, a shaving process using the trimmer blade 20 cannot be performed, and an unintentional injury that may be caused by the cutting edge 22 of the trimmer blade 20 can be prevented.

Referring to FIG. 6, the first receiving parts 38*a* are formed to be located below the second receiving parts 38*b*, respectively, and the fixing protrusions 19 are inserted into the first receiving parts 38*a*, respectively, thereby defining the first position of the trimmer cover 30. As the fixing protrusions 19 engage with the first receiving parts 38*a*, respectively, the trimmer cover 30 can maintain its first position.

As illustrated in FIG. 5, the relative positions of the fixing protrusions 19 and the first receiving parts 38*a* may be determined such that the upper end of the trimmer cover 30 can be located above the cutting edge 22 of the trimmer blade 20 when the trimmer cover 30 is placed at the first position. Preferably, the relative positions of the fixing protrusions 19 and the first receiving parts 38*a* may be determined such that an imaginary plane that the upper end of the trimmer cover 30 and an upper end of the housing 10 are both placed in contact with can be located above the cutting edge 22 of the trimmer blade 20 when the trimmer cover 30 is placed at the first position.

Figure 7:
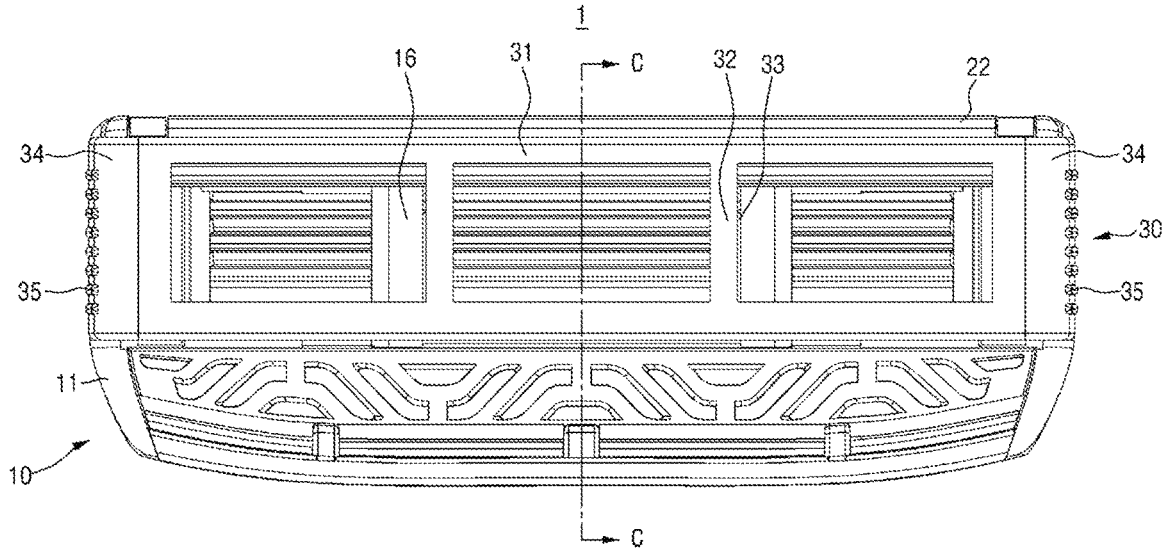
FIG. 7 is a rear view of the razor cartridge according to the first exemplary embodiment in a state where the trimmer cover of the razor cartridge according to the first exemplary embodiment is placed at a second position.
Figure 8:
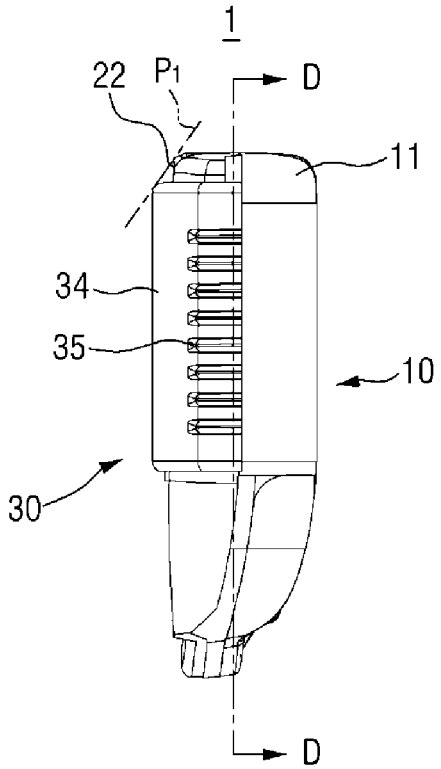
FIG. 8 is a side view of the razor cartridge according to the first exemplary embodiment in a state where the trimmer cover of the razor cartridge according to the first exemplary embodiment is placed at the second position.
Figure 9:
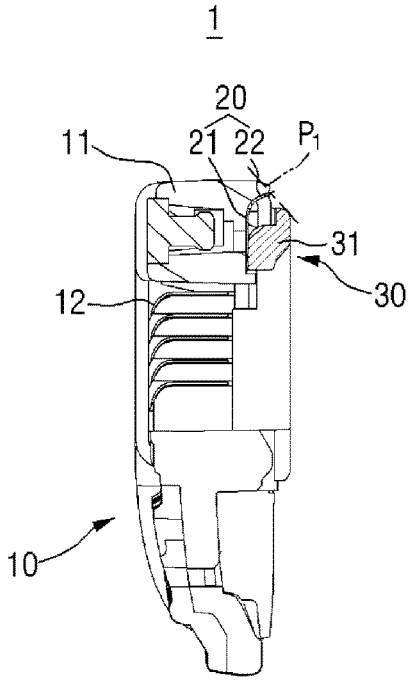
FIG. 9 is a cross-sectional view taken along line C-C of FIG. 7.
Figure 10:
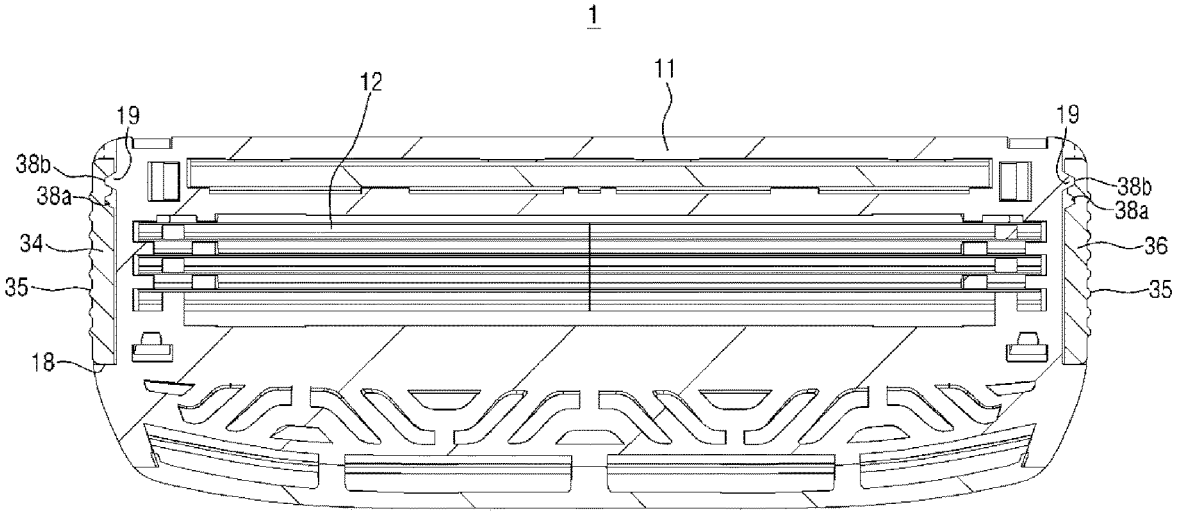
FIG. 10 is a cross-sectional view taken along line D-D of FIG. 8.

FIG. 7 is a rear view of the razor cartridge according to the first exemplary embodiment in a state where the trimmer cover of the razor cartridge according to the first exemplary embodiment is placed at the second position, FIG. 8 is a side view of the razor cartridge according to the first exemplary embodiment in a state where the trimmer cover of the razor cartridge according to the first exemplary embodiment is placed at the second position, FIG. 9 is a cross-sectional view taken along line C-C of FIG. 7, and FIG. 10 is a cross-sectional view taken along line D-D of FIG. 8.

Referring to FIGS. 7 through 9, when the trimmer cover 30 is placed at the second position, the upper end of the trimmer cover 30 is located below the cutting edge 22 of the trimmer blade 20.

That is, since the upper end of the cover base 31 of the trimmer cover 30 is located below the cutting edge 22 of the trimmer blade 22, as viewed from the rear of the razor cartridge 1, the cutting edge 22 of the trimmer blade 20 can be exposed to be observed from the rear of the razor cartridge 1.

Also, since the upper ends of the cover sides 34 of the trimmer cover 30 are located below the cutting edge 22 of the trimmer blade 22, as viewed from the sides of the razor cartridge 1, the cutting edge 22 of the trimmer blade 20 can be exposed to be observed from the sides of the razor cartridge 1.

Referring to FIG. 9, when the trimmer cover 30 is placed at the second position, the trimmer cover 30 determines a trimming plane P1 along with the housing 10. The trimming plane P1, which is a plane that the upper end of the housing 10 and the upper end of the trimmer cover 30 are both placed in contact with, corresponds to the surface of the skin placed in contact with the razor cartridge 1 during a shaving process using the cutting edge 22 of the trimmer blade 20.

In order for the cutting edge 22 to shave body hair, the second position of the trimmer cover 30 may be determined such that the trimming plane P1 can be located near the end of the cutting edge 22. Specifically, the second position of the trimmer cover 30 may be determined such that the end of the cutting edge 22 can be located near, and can pass through, the trimming plane P1, that the cutting edge 22 can be located below the trimming plane P1, or that the cutting edge 22 can be placed in contact with the trimming plane P1.

Referring to FIG. 10, the fixing protrusions 19 are inserted into the second receiving parts 38*b*, respectively, thereby defining the second position of the trimmer cover 30. As the fixing protrusions 19 engage with the second receiving parts 38*b*, respectively, the trimmer cover 30 can maintain its second position.

The relative positions of the fixing protrusions 19 and the second receiving parts 38*b* may be determined such that the upper end of the trimmer cover 30 can be located below the cutting edge 22 of the trimmer blade 20. Specifically, as mentioned above, the relative positions of the fixing protrusions 19 and the second receiving parts 38*b* may preferably be determined such that the trimming plane P1 can be placed in contact with, or located near, the end of the cutting edge 22.

The razor cartridge 1 according to the first exemplary embodiment has been described, taking an example where the upper end of the trimmer cover 30 is located above the cutting edge 22 of the trimmer blade 20 when the trimmer cover 30 is placed at the first position and the upper end of the trimmer cover 30 is located below the cutting edge 22 of the trimmer blade 20 when the trimmer cover 30 is placed at the second position, but the relative positions of the upper end of the trimmer cover 30 and the cutting edge 22 of the trimmer blade 20 when the trimmer cover 30 is placed at the first or second position may vary.

For example, when the trimmer cover 30 is placed at the first or second position, the upper end of the trimmer cover 30 may be located below the cutting edge 22 of the trimmer blade 20.

When the trimmer cover 30 is placed at the second position, the cutting edge 22 of the trimmer blade 20 needs to be located near the trimming plane P1, which is determined by the upper end of the trimmer cover 30 and the upper end of the housing 10, such that a shaving process using the trimmer blade 20 can be performed.

The upper end of the trimmer cover 30 needs to be positioned higher when the trimmer cover 30 is placed at the first position than when the trimmer cover 30 is placed at the second position such that the cutting edge 22 of the trimmer blade 20 cannot be used when the trimmer cover 30 is placed at the first position. That is, the cutting edge 22 of the trimmer blade 22 needs to be located below an imaginary plane that the upper end of the housing 10 and the upper end of the trimmer cover 30 are both placed in contact with when the trimmer cover 30 is placed at the first position.

A razor cartridge according to another exemplary embodiment of the present invention will hereinafter be described. In the accompanying drawings, the same reference numbers are used to designate the same or similar elements, and any redundant descriptions thereof will be omitted.

Figure 11:
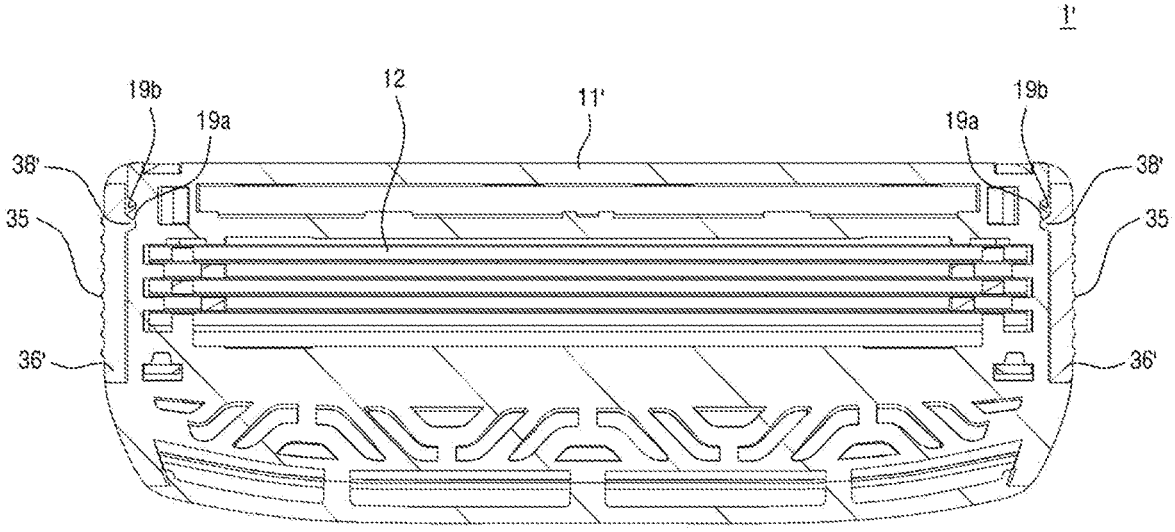
FIG. 11 is a cross-sectional view of a razor cartridge according to a second exemplary embodiment of the present invention.

FIG. 11 is a cross-sectional view of a razor cartridge according to a second exemplary embodiment of the present invention.

In the first exemplary embodiment, the first guide rails 18 are provided with the fixing protrusions 19, respectively, and the first sliding rails 36 are provided with the first receiving parts 38*a*, respectively, and the second receiving parts 38*b*, respectively, thereby defining the first and second positions of the trimmer cover 30. On the other hand, referring to FIG. 11, in a razor cartridge 1' according to the second exemplary embodiment, first guide rails 18 of a frame 11' are provided with first receiving parts 38*a*, respectively, and second receiving parts 38*b*, respectively, and first sliding rails 36' are provided with fixing protrusions 38', respectively.

Accordingly, in the razor cartridge 1' according to the second exemplary embodiment, in response to the fixing protrusions 38' engaging with second receiving parts 19*b*, respectively, a trimmer cover 30 is placed at a second position, as illustrated in FIG. 11. Although not specifically illustrated, in response to the fixing protrusions 38' engaging first receiving parts 19*a*, respectively, the trimmer cover 30 is placed at a first position.

Figure 12:
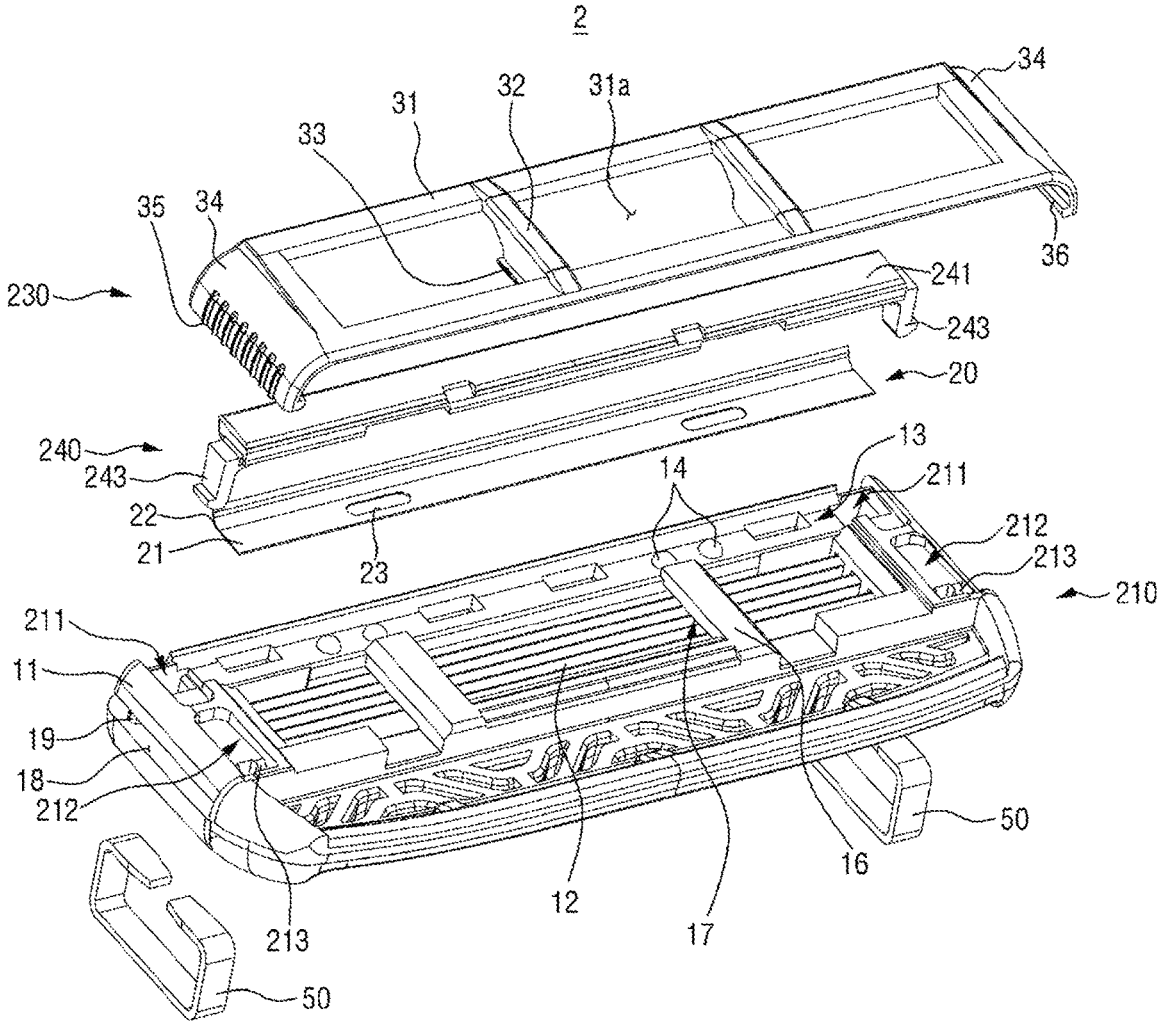
FIG. 12 is an exploded perspective view of a razor cartridge according to a third exemplary embodiment of the present invention.

FIG. 12 is an exploded perspective view of a razor cartridge according to a third exemplary embodiment of the present invention.

Referring to FIG. 12, a razor cartridge 2 according to the third exemplary embodiment, unlike the razor cartridge 1 according to the first exemplary embodiment, further includes a trimmer guard 240, which is provided between a trimmer blade 20 and a trimmer cover 230.

The trimmer guard 240 includes a guard bar 241 and hook legs 243, which extend from both sides of the guard bar 241.

In a housing 210 of the razor cartridge 2 according to the third exemplary embodiment, guard engaging grooves 211 are formed on both sides of a trimmer blade installation groove 13. The hook legs 243 of the trimmer guard 240 are inserted into the guard engaging grooves 211, respectively, thereby forming a hook-coupled space.

First ends of clips 50, which fix a plurality of main blades 12 to a frame 11, may be inserted into the guard engaging grooves 211 from the front of the frame 11, and second ends of the clips 50 may be inserted into clip engaging holes 213 from the front of the frame 11.

Once the guard engaging grooves 211 are inserted into the clip engaging holes 213, respectively, both ends of each of the clips 50 that protrude from the rear of the frame 11 are bent to be placed in contact with clip receiving grooves 212, respectively, which are formed at the rear of the frame 11.

The trimmer guard 240 of the razor cartridge 2 according to the third exemplary embodiment is coupled to the frame 11 after the trimmer blade 20 is installed in the frame 11. When the trimmer blade 20 and the trimmer guard 240 are both coupled to the frame 11, the trimmer blade 20 may be brought into close contact with at least parts of the front surface and the top surface of the trimmer guard 240 with both the trimmer blade 20 and the trimmer guard 240 coupled to the frame 11 (See FIG. 16).

Figure 16:
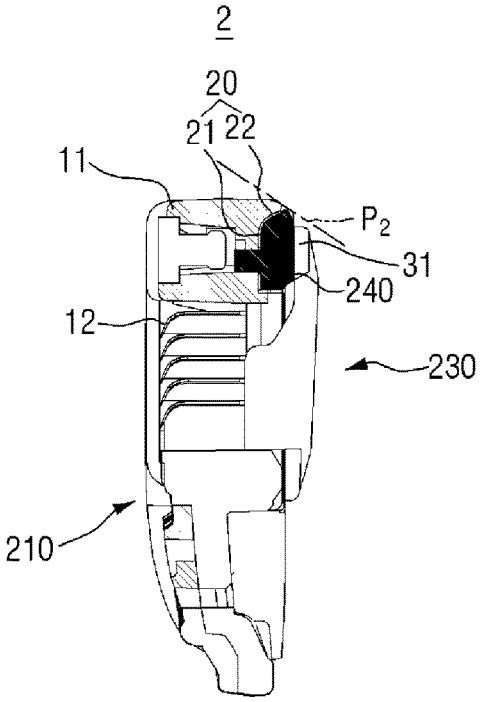
FIG. 16 is a cross-sectional view taken along line F-F of FIG. 15.

In the razor cartridge 2 according to the third exemplary embodiment, an upper end of the trimmer guard 240 forms an imaginary trimming plane P2 with an upper end of the housing 10 (See FIG. 16).

In the razor cartridge 2 according to the first exemplary embodiment, the trimming plane P1 is determined by placing the trimmer cover 30 at the second position, but in the razor cartridge 2 according to the third exemplary embodiment, the trimming plane P2 is determined by the trimmer guard 240, which is fixedly installed regardless of the position of the trimmer cover 230.

Since in the razor cartridge 2 according to the first exemplary embodiment, the trimming plane P1 is determined by the trimming cover 30, which moves back and forth between the first and second positions, the trimming plane P1 may undesirably change due to wear and tear. On the other hand, since in the razor cartridge 2 according to the third exemplary embodiment, the trimming plane P2 is determined by the trimmer guard 240, which is fixedly installed, the razor cartridge 2 according to the third exemplary embodiment can stably maintain the trimming plane P2, compared to the razor cartridge 2 according to the first exemplary embodiment.

The cutting edge 22 of the trimmer blade 20 may be formed to be adjacent to the trimming plane P2 with the trimmer blade 20 and the trimmer guard 240 both coupled to the frame 11. Specifically, the cutting edge 22 of the trimmer blade 20 may be formed such that the end of the cutting edge 22 can be located near, and can pass through, the trimming plane P2, that the cutting edge 22 can be located below the trimming plane P2, or that the cutting edge 22 can be placed in contact with the trimming plane P2.

Figure 13:
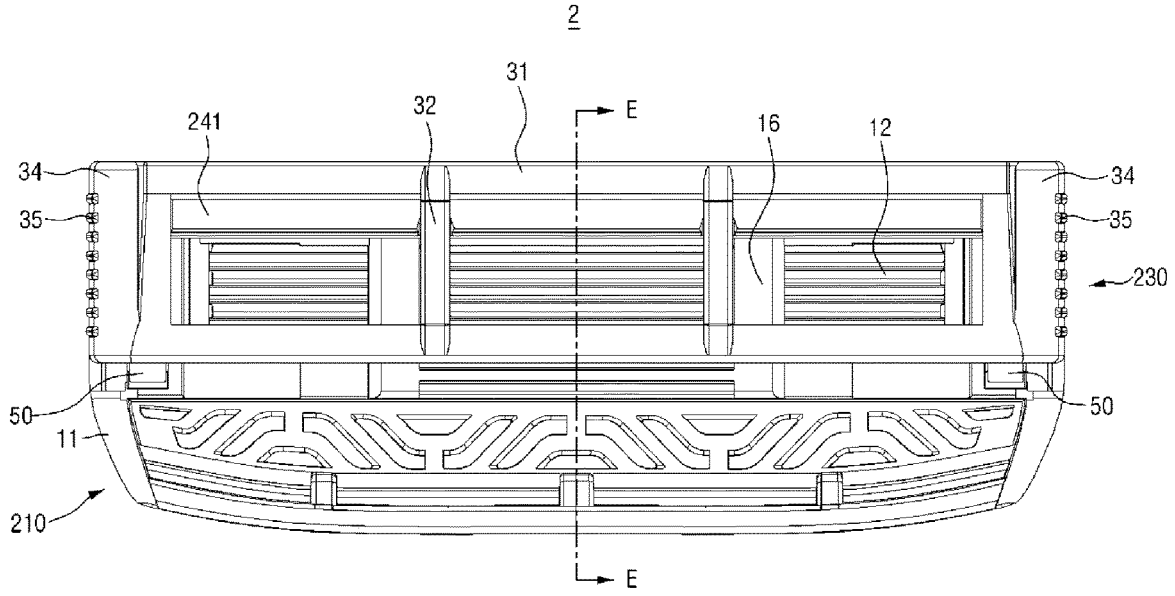
FIG. 13 is a side view of the razor cartridge according to the third exemplary embodiment in a state where a trimmer cover of the razor cartridge according to the third exemplary embodiment is placed at the first position.
Figure 14:
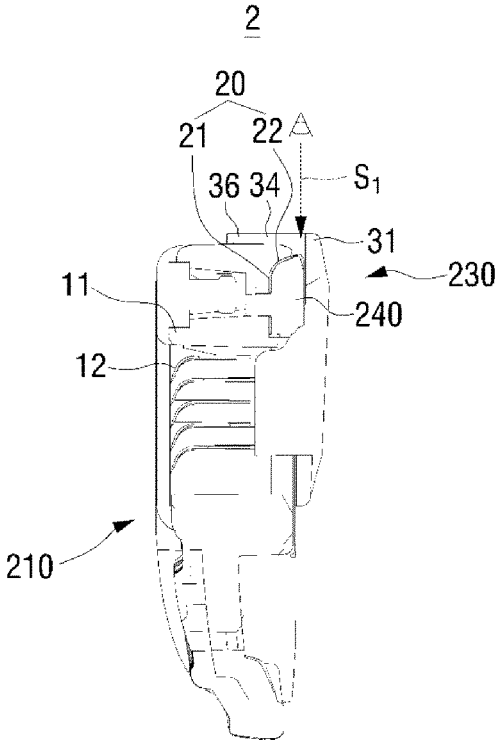
FIG. 14 is a cross-sectional view taken along line E-E of FIG. 13.

FIG. 13 is a side view of the razor cartridge according to the third exemplary embodiment in a state where the trimmer cover of the razor cartridge according to the third exemplary embodiment is placed at the first position, and FIG. 14 is a cross-sectional view taken along line E-E of FIG. 13.

Referring to FIGS. 13 and 14, when the trimmer cover 230 is placed at the first position, the cutting edge 22 of the trimmer blade 20 cannot be observed from the rear and the sides of the razor cartridge 2.

As illustrated in FIG. 14, the cutting edge of the trimmer blade 20 can be observed between the frame 11 and the trimmer cover 230, only when viewed from a direction $S_1$ from above the razor cartridge 2.

In the third exemplary embodiment, like in the first exemplary embodiment, when the trimmer cover 230 is placed at the first position, the cutting edge 22 of the trimmer blade 20 can be observed, only when viewed from the direction $S_1$ from above the razor cartridge 2, and cannot be exposed to the outside of the razor cartridge 2. Thus, when the trimmer cover 230 is placed at the first position, a shaving process using the trimmer blade 20 cannot be performed, and an unintentional injury that may be caused by the cutting edge 22 of the trimmer blade 20 can be prevented.

As illustrated in FIG. 14, when the trimmer cover 230 is placed at the first position, the cover base 31 of the trimmer cover 230 and upper ends of cover sides 34 are located above the cutting edge 22 of the trimmer blade 20. Preferably, the upper end of the trimmer cover 230 is located higher than the trimming plane P2.

Figure 15:
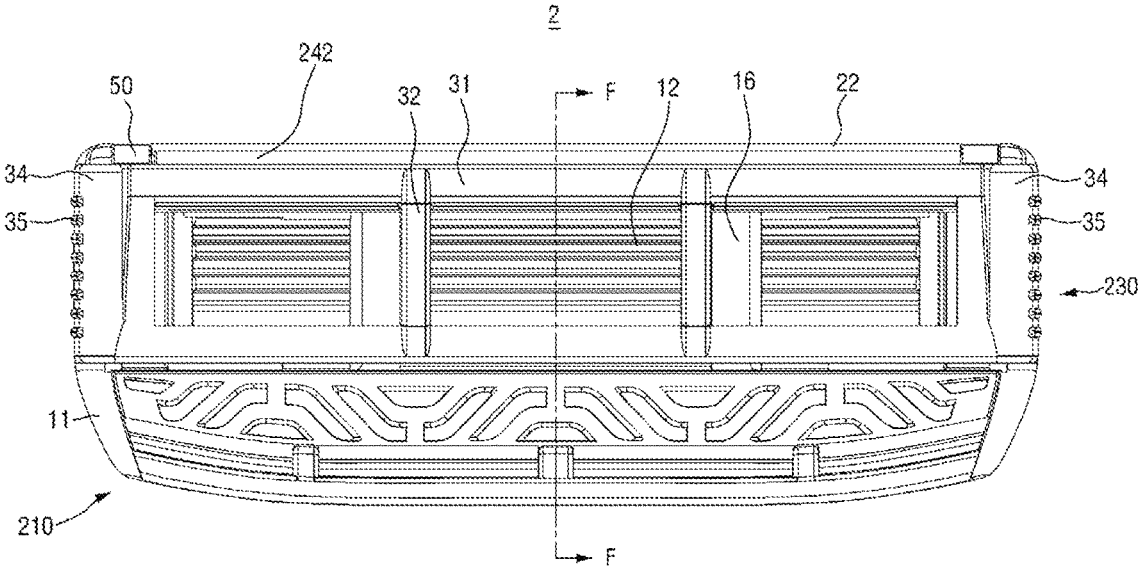
FIG. 15 is a side view of the razor cartridge according to the third exemplary embodiment in a state where a trimmer cover of the razor cartridge according to the third exemplary embodiment is placed at the second position.

FIG. 15 is a side view of the razor cartridge according to the third exemplary embodiment in a state where the trimmer cover of the razor cartridge according to the third exemplary embodiment is placed at the second position, and FIG. 16 is a cross-sectional view taken along line F-F of FIG. 15.

Referring to FIGS. 15 and 16, when the trimmer cover 230 is placed at the second position, the cutting edge 22 of the trimmer blade 20 is exposed to be observed from the rear and the sides of the razor cartridge 2. Accordingly, when the trimmer cover 230 is placed at the second position, the cutting edge 22 of the trimmer blade 20 is able to perform a body hair shaving process.

In order for the cutting edge 22 to stably perform a body hair shaving process, the upper ends of the cover base 31 and the cover sides 34 of the trimmer cover 230 are preferably located below the trimming plane P2, as illustrated in FIG. 16, when the trimmer cover 230 is placed at the second position.

As described above, in the razor cartridge 1, 1', or 2, the trimmer cover 30 or 230 is configured to be vertically slidable with respect to the housing 10 and can thus be located between the first position where the cutting edge 22 of the trimmer blade 20 is not exposed and the second position where the cutting edge 22 of the trimmer blade 20 is exposed. Accordingly, in order to use the trimmer blade 20, the trimmer cover 30 or 230 is placed at the second position so that body hair can be shaved with the trimmer blade 20. On the other hand, when the trimmer blade 20 is not in use, the trimmer cover 30 or 230 is placed at the first position so that the cutting edge 22 of the trimmer blade 20 cannot be exposed on the outside of the razor cartridge 1, 1', or 2 to prevent an unintentional injury.

Those skilled in the art will appreciate that many variations and modifications can be made to the preferred embodiments without substantially departing from the principles of the present invention. Therefore, the disclosed preferred embodiments of the invention are used in a generic and descriptive sense only and not for purposes of limitation. The scope of the present invention is defined by the appended claims rather than the detailed description, and all changes or modifications derived from the meaning and scope of the claims and their equivalents are to be construed as being included within the scope of the present invention.

What is claimed is:

1. A razor cartridge, comprising:

at least one main blade;

a trimmer blade;

a housing accommodating the at least one main blade so as for a cutting edge of the at least one main blade to be exposed at the front of the housing and accommodating the trimmer blade so as for a cutting edge of the trimmer blade is positioned at the rear of the housing; and a trimmer cover provided at the rear of the housing to be slidable on the housing and configured to move back and forth between a first position and a second position, wherein:

the trimmer cover includes a cover base having a plurality of frames, each of the plurality of frames having an opening exposing at least a portion of the at least one main blade;

when the trimmer cover is placed at the first position, one end of the trimmer cover is located higher than the cutting edge of the trimmer blade along a sliding direction of the trimmer cover; and when the trimmer cover is placed at the second position, the cutting edge of the trimmer blade is located higher than the one end of the trimmer cover along the sliding direction of the trimmer cover.

2. The razor cartridge of claim 1, wherein when the trimmer cover is slid in a first direction from the first position to be placed at the second position, the one end of the trimmer cover is located below the cutting edge of the trimmer blade, fully exposing the cutting edge of the trimmer blade.

3. The razor cartridge of claim 1, wherein the one end of the trimmer cover is positioned higher than the cutting edge of the trimmer blade when the trimmer cover is slid in a second direction opposite to the first direction from the second position to be placed at the first position such that the cutting edge of the trimmer blade is covered by the trimmer cover.

4. The razor cartridge of claim 1, wherein guide rails are formed at the housing to guide the movement of the trimmer cover, and the trimmer cover includes sliding rails, which move along the guide rails.

5. The razor cartridge of claim 4, wherein the guide rails include fixing protrusions, respectively, which protrude outwardly, and the sliding rails include first receiving parts, respectively, which engage with the fixing protrusions, respectively, and thus maintain the trimmer cover at the first position when the trimmer cover is placed at the first position, and second receiving parts, respectively, which engage with the fixing protrusions, respectively, and thus maintain the trimmer cover at the second position when the trimmer cover is placed at the second position.

6. The razor cartridge of claim 4, wherein the sliding rails include fixing protrusions, respectively, which protrude outwardly, and the guide rails include first receiving parts, respectively, which engage with the fixing protrusions, respectively, and thus maintain the trimmer cover at the first position when the trimmer cover is placed at the first position, and second receiving parts, respectively, which engage with the fixing protrusions, respectively, and thus maintain the trimmer cover at the second position when the trimmer cover is placed at the second position.

7. The razor cartridge of claim 1, further comprising:

a trimmer guard provided between the trimmer blade and the trimmer cover, wherein the trimmer guard forms, together with the housing, an imaginary trimming plane that is adjacent to the cutting edge of the trimmer blade.

8. The razor cartridge of claim 7, wherein when the trimmer cover is placed at the first position, the upper end of the trimmer cover is located beyond the trimming plane.

9. The razor cartridge of claim 7, wherein when the trimmer cover is placed at the second position, the upper end of the trimmer cover is located behind the trimmer plane.

10. The razor cartridge of claim 1, wherein the openings of the trimmer cover are configured to allow water to pass through the front and rear of the razor cartridge when the razor cartridge is washed with the water such that the at least one main blade is washed by the water.

11. The razor cartridge of claim 1, wherein the trimmer blade comprises a trimmer base comprising a single bent portion, and the cutting edge is formed at an end of the trimmer blade.

12. The razor cartridge of claim 11, wherein the cutting edge of the trimmer blade extending from the trimmer base is visible through a space formed between a frame of the housing and the trimmer cover when the cutting edge of the trimmer blade is in the first position.

13. The razor cartridge of claim 12, wherein the cutting edge of the trimmer blade is exposed between a portion of the frame of the housing and a portion of the trimmer cover when the cutting edge of the trimmer blade is in the second position.

14. The razor cartridge of claim 1, wherein the trimmer cover further includes cover sides extending from both sides of the cover base.

15. The razor cartridge of claim 14, wherein the trimmer cover further includes two connecting bars which connect upper and lower parts of the cover base.

* * * * *